US005872503A

United States Patent [19]

Marquis et al.

[11] Patent Number: 5,872,503

[45] Date of Patent: Feb. 16, 1999

[54] SCANNING POTENTIOMETER, PARTICULARLY FOR A RAPID-ORIENTATION APPARATUS ON AN OBSERVATION AND/OR ARTILLERY VEHICLE

[75] Inventors: Gerard Marquis, Zurich; Martin Wittwer, Kloten, both of Switzerland

[73] Assignee: Oerlikon Contraves AG, Zürich, Switzerland

[21] Appl. No.: 798,271

[22] Filed: Feb. 11, 1997

[30] Foreign Application Priority Data

Feb. 14, 1996 [CH] Switzerland ..... 00374/96

[51] Int. Cl.[6] ..... H01C 3/06

[52] U.S. Cl. ..... 338/210; 338/210; 338/211; 338/212

[58] Field of Search ..... 338/99, 210, 47, 338/96, 114, 71, 154, 92, 196, 69

[56] References Cited

U.S. PATENT DOCUMENTS

| | | | |
|---|---|---|---|
| 3,463,990 | 8/1969 | Ross et al. | 338/99 |
| 3,610,887 | 10/1971 | Betzer et al. | 219/501 |
| 3,626,350 | 12/1971 | Susuki et al. | 338/69 |
| 3,968,467 | 7/1976 | Lampen et al. | 338/119 |
| 4,114,134 | 9/1978 | Kley | 338/231 |
| 4,143,367 | 3/1979 | Schestag | 340/540 |
| 4,172,216 | 10/1979 | O'Shea et al. | 200/85 |
| 4,479,392 | 10/1984 | Froeb et al. | 73/862.68 |
| 4,583,032 | 4/1986 | Nunziata et al. | 318/666 |
| 5,014,224 | 5/1991 | Hans et al. | 338/99 |
| 5,068,638 | 11/1991 | Bickely et al. | 338/114 |
| 5,151,677 | 9/1992 | Gernet et al. | 338/99 |
| 5,334,967 | 8/1994 | Paszkiewicz et al. | 338/95 |

FOREIGN PATENT DOCUMENTS

| | | |
|---|---|---|
| 0353127 | 1/1990 | European Pat. Off. . |
| 0455838 | 11/1991 | European Pat. Off. . |
| 2366432 | 4/1978 | France . |
| 2519051 | 11/1975 | Germany . |
| 2253059 | 8/1992 | United Kingdom . |

*Primary Examiner*—Michael L. Gellner
*Assistant Examiner*—Jeffrey Pwu
*Attorney, Agent, or Firm*—Browdy and Neimark

[57] ABSTRACT

A scanning potentiometer adapted to a hatch edge prevents buckling of an insulating cover (2) which has a contact strip (10) and a resistor strip (14) during bending and prevents undesired contact. The insulating cover (2) has two profiles (3, 4), with a reinforcing device provided in at least one of the profiles (3, 4). In a preferred embodiment, the reinforcing device has tubular conduits (5, 6) that are integrated into one of the profiles (3, 4), namely the profile (3) that includes an actuation surface (7) of the scanning potentiometer.

19 Claims, 2 Drawing Sheets

SCANNING POTENTIOMETER, PARTICULARLY FOR A RAPID-ORIENTATION APPARATUS ON AN OBSERVATION AND/OR ARTILLERY VEHICLE

FIELD OF THE INVENTION

The invention relates to a scanning potentiometer, particularly for a rapid-orientation apparatus on an observation and/or artillery vehicle, the scanning potentiometer being disposed around an observer's station inside the vehicle, and having a hose-like insulating cover, in which a resistor strip and a contact strip extend coaxially with specific spacing from one another.

REVIEW OF THE RELATED TECHNOLOGY

In vehicles of the type mentioned at the outset, such as combat tanks, the surroundings are continuously observed visually from inside the vehicle, either directly out of the open hatch or with the use of a built-in angled mirror. If a possible target is discovered, it must be detected with a rotatably-mounted periscope, whose field of sight is extremely limited, for precise assessment. Thus, it is necessary to orient the periscope (and possibly the gun barrel) in the direction of the target as quickly as possible, that is, the observer must impart the direction that he has determined visually to the periscope so that he can orient himself quickly in the surrounding area when he subsequently looks through the periscope.

Generally, orientation is effected by the operation of a directional handle or joystick for servo-driven rotation of the periscope or tower, with the direction being displayed on a scale inside the vehicle. The observer, therefore, must typically change his body position and change direction to the scale, which impedes the process of finding the direction again and wastes valuable time.

A rapid-orientation apparatus that does not have the aforementioned disadvantages is known from EP-A-0 455 838. In this instance, a scanning potentiometer that serves as an analog angle generator for rapidly driving a periscope encircles the observation area along a hatch edge.

The scanning potentiometer has a flexible, hose-like insulating cover that is formed from a semicircular, hollow profile (e.g., an extrusion). Disposed on the semicircular inside of the insulating cover is a resistor strip comprising a resistor wire that is guided to be longitudinally movable in an electrically-conductive elastomer hose. A contact strip formed from a flat metal profile is disposed on the planar inside of the insulating cover, parallel to the resistor strip and at a certain distance therefrom. Tubular parts are placed onto the ends of the hose in which the resistor wire is guided.

The ends of the resistor wire are connected to a conduit by way of flexible multiple conductors, with the conductors being guided in helical shape in the tubular parts. This measure is intended to permit an equalization of length, because the resistor wire is pushed out of the hose, in the direction of the tubular parts, when the scanning potentiometer is bent.

The scanning potentiometer is secured to the hatch edge by its planar support surface, while the semicircular part of the insulating cover, with the resistor strip secured in the interior, faces the observation area. If an observer actuates the scanning potentiometer in a sighting direction by pressing the hose-like insulating cover at the relevant point until the resistor strip touches the contact strip, an electrical potential is tapped which represents a measure for the direction in which the periscope must be pivoted.

A disadvantage of the scanning potentiometer of the above described rapid-orientation apparatus is that, during bending to adapt the assembly to the hatch edge, the cover can buckle, which produces an undesired contact between the resistor strip and the contact strip.

In addition, because of the flat metal profile used as a contact strip, smaller radii are not possible when the scanning potentiometer is installed, which can cause problems depending on the configuration of the hatch edge.

Another disadvantage is that the resistor strip is mechanically stressed with each actuation, so that changes in resistance may occur, necessitating a re-equalization. The relatively involved and costly connection between the resistor wire and the cable is also disadvantageous.

SUMMARY OF THE INVENTION

An object of the invention is to propose a scanning potentiometer of the type mentioned at the outset that does not have the aforementioned disadvantages.

This object is accomplished by the invention disclosed below. The hose-like (hollow) insulating cover comprises two profiles (i.e. elongated members or, objects with relatively constant cross-sections), with a reinforcing device (or reinforcement) being provided in at least one of the profiles. In a preferred embodiment, the reinforcing device comprises tubular conduits integrated into (integral with) one of the profiles, namely the one that includes an actuation surface of the scanning potentiometer.

In particular, the advantages that can be attained with the invention are that, with the proposed reinforcing device, smaller bending radii can be achieved during assembly; nevertheless, a buckling of the hose-like insulating cover and the consequential erroneous contact can be avoided. The use of a highly-flexible ribbon conductor supports the production of smaller bending radii during assembly of the scanning potentiometer, and facilitates the actuation of the scanning potentiometer.

Further advantages ensue from the fact that the resistor strip is no longer moved during actuation of the scanning potentiometer. Consequently, the connection between the resistor wire and the cable can be produced more simply and less expensively. Moreover, changes in the electrical resistance no longer take place due to mechanical stress of the resistor strip, so no re-equalization needs to be performed later.

BRIEF DESCRIPTION OF THE DRAWING

The above and other objects and the nature and advantages of the present invention will become more apparent from the following detailed description of an embodiment[s] taken in conjunction with drawings, wherein.

DETAILED DESCRIPTION OF THE PREFERRED EMBODIMENT

Figure 1:
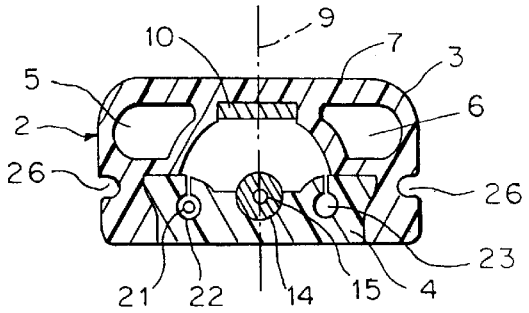
FIG. 1 is a cross-sectional view through the scanning potentiometer of the invention.
Figure 2:
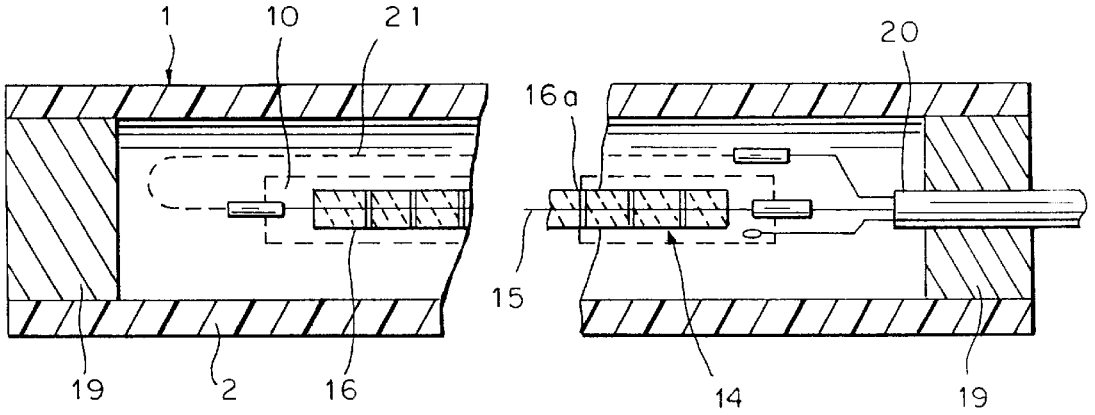
FIG. 2 is a schematic view of a longitudinal section of the scanning potentiometer according to FIG. 1.

FIGS. 1 through 4 show a scanning potentiometer 1 having a hose-like insulating cover 2. The insulating cover 2 is a combination of two profiles 3, 4, for example of silicone rubber, and has an essentially rectangular cross section. Provided at the insulating cover 2 is a reinforcing device comprising two tubular conduits 5, 6, which are integrated into the profile 3 that includes an actuation surface 7 of the scanning potentiometer 1. The conduits 5, 6 are disposed on the two narrow sides of a rectangular depression 8 that is provided on the inside of the profile 3, symmetrically to a central axis 9.

A contact strip 10 formed from a highly-flexible ribbon conductor is secured in the rectangular depression 8. An open side of the profile 3 that extends parallel to the actuation surface 7 is sealed by the other profile 4 in the final assembly of the scanning potentiometer 1. For this purpose, the profile 4 is guided in dovetail fashion in the profile 3: trapezoidal guide tabs 11 of the profile 4 extend into trapezoidal guide grooves 12 of the profile 3.

Figure 3:
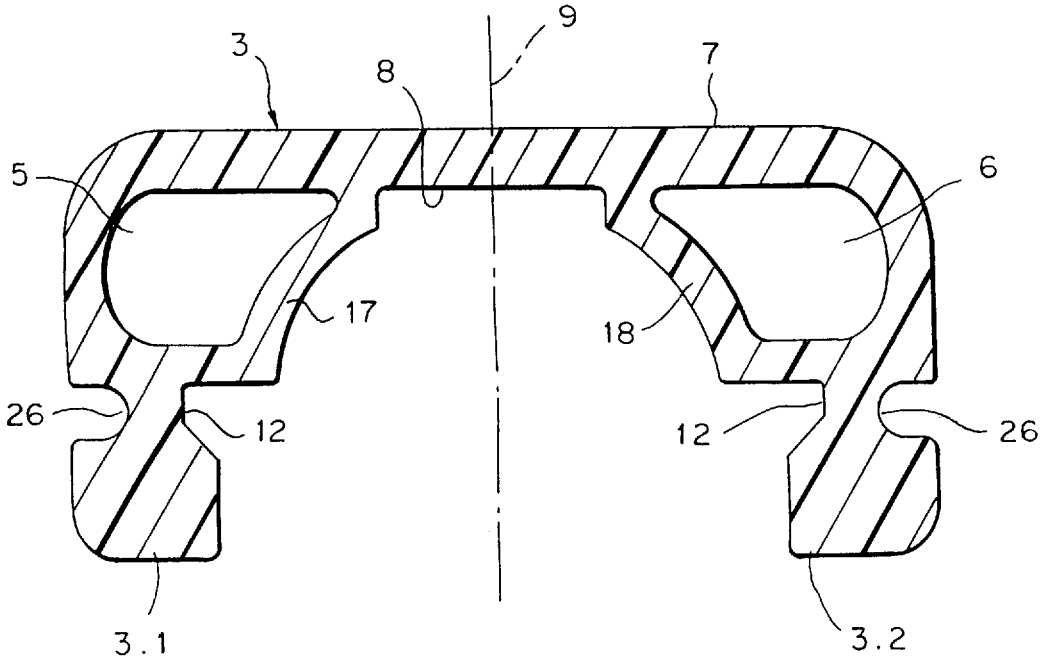
FIG. 3 is a cross-sectional view of a first profile of a hose-like insulating cover of the scanning potentiometer.
Figure 4:
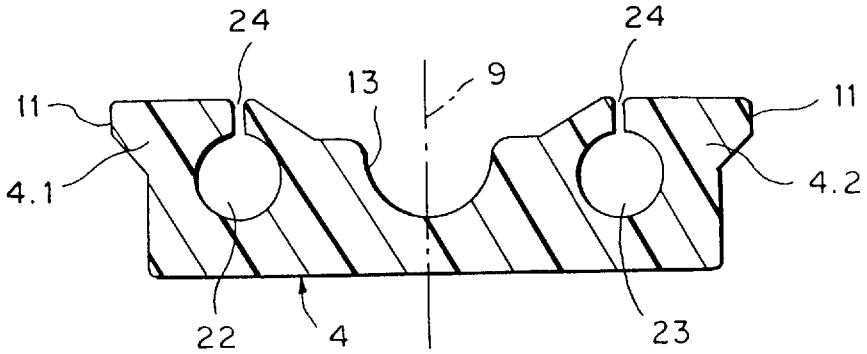
FIG. 4 is a cross-sectional view of a second profile of the hose-like insulating cover of the scanning potentiometer.

As seen in FIG. 3, the first profile or elongated member 3 of the insulating cover 2 includes in cross section a first end area 3.1 and a second end area 3.2. As seen in FIG. 4, the second profile or elongated member 4 of the insulating cover 2 includes in cross section a first end region 4.1 and a second region 4.2. The first and second elongated members 3 and 4 are joined with the first area 3.1 mating to the first region 4.1 and the second area 3.2 mating with the second region 4.2. A joint area is disposed between the two end areas 3.1 and 3.2.

Provided on the inside of the profile 4 is a groove 13 which extends symmetrically to the central axis 9 and in which a resistor strip 14 is disposed. The resistor strip 14 comprises a resistor wire 15, on which contact beads 16 are concatenated that comprise an electrically-conducting material, for example elastomer materials, and are separated from one another by insulating rings 16*a*, whose inner bore is larger than the outer diameter of the resistor wire 15.

The walls 17, 18 of the conduits 5, 6, which walls face the interior of the profile 3, are curved in the manner of circular arcs, with the center point of the curve lying on the central axis 9 and coinciding with the center point of the resistor wire 15.

The outer diameter of the insulating rings 16*a* is advantageously slightly smaller than that of the contiguous contact beads 16.

The ends of the insulating cover 2 are each sealed by a plug 19; a connecting cable 20 is guided through one plug 19. The connecting cable 20 has three conductors, of which one is connected directly to one end of the resistor wire 15 and another is connected to the other end of the resistor wire 15 by way of a return line 21. The third conductor of the connecting cable 20 is connected to the contact strip 10. The return line 21 extends in one of two conduit-shaped, slotted tubes 22, 23, which are provided on both sides of the groove 13 in the profile 4 and are connected to the inside of the profile 4 by way of slots 24.

Figure 5:
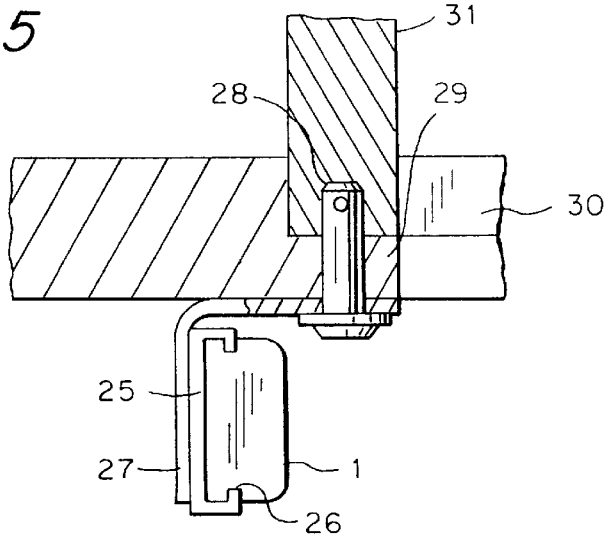
FIG. 5 is a cross-sectional view through the edge region of a vehicle hatch with the scanning potentiometer.

In accordance with FIG. 5, the scanning potentiometer 1 is secured to a rail 25 comprising a C-profile and extending into grooves 26 located on the side of the profile 3 of the scanning potentiometer 1. The rail 25 is held, in a manner not shown, to an angular support 27 that is secured by screws 28 to the edge 29 of a vehicle hatch 30.

With the proposed reinforcing device comprising to two conduits 5, 6, bending radii of up to 12 cm can be attained during mounting of the scanning potentiometer 1 along the edge 29 of the vehicle hatch 30, without the insulating cover 2 being able to buckle and produce an undesired contact between the contact strip 10 and the resistor strip 14. The problem-free production of small bending radii of this type is particularly advantageous in non-circular vehicle hatches 30 connected to the hatch edge by way of a flange 31.

The above-described scanning potentiometer 1 is connected, for example, to a servo control for the rotating drive of a periscope. If an observer located in the vehicle hatch 30 depresses the actuation surface 7 of the scanning potentiometer in a sighted direction until the contact strip 10 touches the resistor strip 14, an electrical potential is tapped which represents a measure for the direction in which the periscope must be pivoted.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments.

The means and materials for carrying out various disclosed functions may take a variety of alternative forms without departing from the invention. It is to be understood that the phraseology or terminology employed herein is for the purpose of description and not of limitation.

What is claimed is:

1. A scanning potentiometer (1), to be disposed around an observation area in a vehicle interior of an observer and/or artillery vehicle, the potentiometer comprising:

a resistor strip (14);

a contact strip (10);

a hollow insulating cover (2), the resistor strip (14) and the contact strip (10) being disposed within the insulating cover and extending parallel to one another with a specific spacing;

the insulating cover (2) comprising elongated members including a first elongated member (3) and a second elongated member (4), at least one of the elongated members (3, 4) including a reinforcement;

wherein the reinforcing device comprises tubular conduits (5, 6) that are integral with at least one of the first elongated member (3) and the second elongated member (4);

wherein the reinforcing device is integral with the first elongated member (3) and the first elongated member includes an actuation surface (7) of the scanning potentiometer (1);

wherein the conduits (5, 6) of the reinforcing device are disposed symmetrically to a central axis (9) on two narrow sides of a rectangular depression (8) on the inside of the first elongated member (3);

including walls (17, 18) of the conduits (5, 6) facing an interior of the first elongated member (3), the walls being curved in a generally circular arc, with a center point of the curve lying on the central axis (9);

wherein the second elongated member (4) includes dovetail means for guiding in the first elongated member (3), and wherein trapezoidal guide tabs (11) of the second elongated member (4) extend into trapezoidal guide grooves (12) of the first elongated member (3).

2. The scanning potentiometer according to claim 1, including a groove (13) disposed symmetrically with respect to the central axis (9) on an inside of the second profile (4), and tubes (22, 23) extending in the second profile (4) and are connected to the inside of the second profile by way of slots (24) disposed on both sides of the groove (13).

3. The scanning potentiometer according to claim 2, including a rail (25) comprising a C-profile and grooves (26) provided on the sides of the one profile (3).

4. The scanning potentiometer according to claim 2, wherein the contact strip (10) is disposed at the inside end of the first profile (3) that includes the actuation surface (7), the resistor strip (14) is disposed on the inside of the second profile (4), and wherein the contact strip (10) includes a highly-flexible ribbon conductor secured in the rectangular depression (8).

5. The scanning potentiometer according to claim 4, wherein the resistor strip (14) comprises a resistor wire (15) and on which contact beads (16) of electrically-conducting material are concatenated, and wherein the resistor strip (14) is guided in the groove (13).

6. The scanning potentiometer according to claim 5, wherein the resistor strip (14) comprises a resistor wire (15) on which contact beads (16) of electrically-conducting material are concatenated, which beads are electrically separated from one another by insulating rings (16*a*).

7. The scanning potentiometer according to claim 5, wherein the insulating rings (16*a*) have a smaller outer diameter than the contiguous contact beads (16) of electrically-conducting material.

8. The scanning potentiometer according to claim 6, wherein the insulating rings (16*a*) have a smaller outer diameter than the contiguous contact beads (16) of electrically-conducting material.

9. The scanning potentiometer according to claim 2, including means by which the scanning potentiometer (1) is secured to an edge (29) of a vehicle hatch (30).

10. The scanning potentiometer according to claim 3, including means by which the scanning potentiometer (1) is secured to an edge (29) of a vehicle hatch (30).

11. The scanning potentiometer according to claim 1, wherein the hose-like insulating cover (2) includes an essentially rectangular cross section when not distorted by outside forces.

12. In a scanning potentiometer (1) to be disposed around an observation area in a vehicle interior of an observer and/or artillery vehicle, the potentiometer of the type having:

a resistor strip (14);

a contact strip (10);

a hollow insulating cover (2), the resistor strip (14) and the contact strip (10) being disposed within the insulating cover and extending parallel to one another with a specific spacing;

the insulating cover (2) including a first elongated member (3) further including in a first cross section thereof a first end area (3.1), a second end area (3.2), and a joint area;

the improvement wherein the hollow insulating cover further comprises a second elongated member further including in a second cross section thereof a first end region (4.1) and a second end region (4.2), whereby the first and second elongated members are joined with the first area mating to the first region and the second area mating to the second region; and wherein at least one of the elongated members (3, 4) includes a reinforcement.

13. The scanning potentiometer according to claim 12, wherein the hollow insulating cover (2) includes an essentially rectangular cover cross section when not distorted by outside forces.

14. The scanning potentiometer according to claim 12, wherein the reinforcement comprises separation walls (17, 18) integral with at least one of the first elongated member and the second elongated member, the separation walls defining tubular conduits (5, 6) therein.

15. The scanning potentiometer according to claim 14, comprising an actuation surface (7) and wherein the first elongated member includes the actuation surface (7) and the reinforcement.

16. The scanning potentiometer according to claim 15, wherein the conduits (5, 6) of the reinforcing device are disposed on two narrow sides of a rectangular depression (8) disposed on an inside of the first elongated member (3) symmetrically to a central axis (9) thereof.

17. The scanning potentiometer according to claim 16, wherein the separation walls (17, 18) of the conduits (5, 6) include inner surfaces facing an interior of the first elongated member (3) and the inner surfaces walls are curved in a generally circular arc, with a center point of the curve lying on the central axis (9).

18. In a scanning potentiometer (1) to be disposed around an observation area in a vehicle interior of an observer and/or artillery vehicle, the potentiometer of the type having:

a resistor strip (14);

a contact strip (10);

a hollow insulating cover (2), the resistor strip (14) and the contact strip (10) being disposed within the insulating cover and extending parallel to one another with a specific spacing; the improvement wherein the insulating cover (2) includes a reinforcement.

19. In a scanning potentiometer (1) to be disposed around an observation area in a vehicle interior of an observer and/or artillery vehicle, the potentiometer of the type having a resistor strip (14);

a contact strip (10);

a hollow insulating cover (2), the resistor strip (14) and the contact strip (10) being disposed within the insulating cover and extending parallel to one another with a specific spacing;

the insulating cover (2) including a first elongated member (3) further including in a first cross section thereof a first end area (3.1), a second end area (3.2), and a joint area;

the improvement wherein the hollow insulating cover further comprises a second elongated member further including in a second cross section thereof a first end region (4.1) and a second end region (4.2), whereby the first and second elongated members are joined with the first area mating to the first region and the second area mating to the second region.

* * * * *